United States Patent [19]

Fukumoto

[11] Patent Number: 5,020,838

[45] Date of Patent: Jun. 4, 1991

[54] LUGGAGE-DOOR LOCK DEVICE

[75] Inventor: Ryoichi Fukumoto, Nagoya, Japan

[73] Assignee: Aisin Seiki Kabushiki Kaisha, Kariya, Japan

[21] Appl. No.: 415,955

[22] Filed: Oct. 2, 1989

[30] Foreign Application Priority Data

Sep. 30, 1988 [JP] Japan ..... 63-248479

[51] Int. Cl.[5] ..... E05C 3/26

[52] U.S. Cl. ..... 292/201; 292/216; 292/DIG. 43; 292/DIG. 56; 292/341.12

[58] Field of Search ..... 292/201, 216, 341.16, 292/DIG. 43, 341.12, DIG. 56

[56] References Cited

U.S. PATENT DOCUMENTS

| | | | |
|---|---|---|---|
| 2,943,880 | 7/1960 | Joachim et al. | 292/DIG. 43 X |
| 4,358,141 | 11/1982 | Hamada | 292/DIG. 56 |
| 4,518,181 | 4/1985 | Yamada | 292/201 |
| 4,569,544 | 2/1986 | Escaravage | 292/201 X |
| 4,624,491 | 11/1986 | Vincent | 292/201 |
| 4,652,027 | 3/1987 | Quantz | 292/201 |
| 4,707,007 | 11/1987 | Inoh | 292/216 X |
| 4,735,447 | 4/1988 | Kleefeldt | 292/201 X |
| 4,821,521 | 4/1987 | Schülen | 292/216 X |
| 4,869,536 | 9/1989 | Kleefeldt | 292/DIG. 56 |

*Primary Examiner*—Eric K. Nicholson

*Attorney, Agent, or Firm*—Burns, Doane, Swecker & Mathis

[57] ABSTRACT

A luggage-door lock device includes a latch having a pawl engaged with a striker secured to a body and a spring urging the pawl towards the striker. The engagement is assured by the engagement between the latch and a swing member, by removing the swing member from the latch as a result of a motor-operated mechanism, so that the pawl is removed from the striker. Due to the reaction of the spring after resulting removal, a lid to which the latch is secured is moved in an opening direction.

6 Claims, 2 Drawing Sheets

LUGGAGE-DOOR LOCK DEVICE

BACKGROUND OF THE INVENTION

1. Field of the Invention

The present invention relates to a luggage-door lock device and in particular to a device for locking a lid which is pivotally connected to a body of a vehicle.

2. Description of the Related Art

In general, a vehicle body is provided with a space for accommodating therein one or more pieces of luggage. A lid is provided for closing the opening through which the space is accessed. The lid is pivoted to the vehicle-body and has a pawl which is in engagement with a striker secured to the vehicle-body.

Upon transfer of the luggage or other things to and from the space to the outside, the above-mentioned engagement is released by removing the pawl from the striker so as to expose the opening to the outside. A solenoid is employed for moving the pawl.

However, the movement of the pawl in preparation for the unlocked condition of the lid generates relatively loud noise. In addition, the installation of the solenoid within the lid is cumbersome work since the solenoid is relatively large in mass.

SUMMARY OF THE INVENTION

It is, therefore, a primary object of the present invention to provide a luggage door-lock device without the aforementioned drawbacks.

Another object of the present invention is to provide a luggage door-lock device which can be reduced in mass.

To achieve the objects and in accordance with the purposes of the present invention, for example, a luggage-door lock device includes a body having therein a space and provided with an opening through which the space is accessible. A striker element is secured to a portion near the opening of the body and a lid is pivoted to the body for closing the opening of the body. A base is secured to the lid and a latch, provided with a pawl, is movable between a first position at which the pawl is in engagement with the striker and a second position at which the pawl is fully disengaged with the striker. A swing member is pivoted to the base and has a shoulder with which the latch at its first position is engaged. A spring is disposed between the swing member and the latch so that the engagement therebetween may be assured and the latch may be urged continually towards its second position. A drive motor and shaft is provided with a worm gear and a worm-wheel is provided at a peripheral portion thereof with a geared portion engaged with the worm in such manner that the rotation is transmitted from the worm gear to the geared-portion and vice versa. A projection engages with the swing member and is mounted rotatably on the base. A return-spring returns the worm-wheel to its original position upon completion of the rotation of the worm-wheel for disengaging the pawl from the striker.

BRIEF DESCRIPTION OF THE DRAWINGS

The above and other objects, features and advantages of the present invention will become more apparent and more readily appreciated from the following detailed description of preferred exemplary embodiment of the present invention, taken in connection with the accompanying drawings, in which.

DETAILED DESCRIPTION OF A PREFERRED EMBODIMENT

Referring now to FIGS. 1 through 5, a vehicle body 80 is provided at a rear-end thereof with an opening 81 through which a space 82 is accessed.

Figure 2:
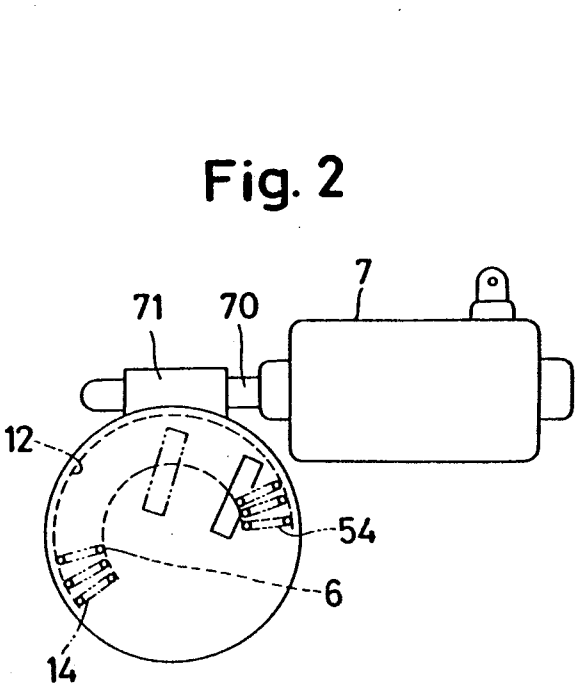
FIG. 2 is a view showing the relationship between the motor and worm-wheel of the invention.
Figure 1:
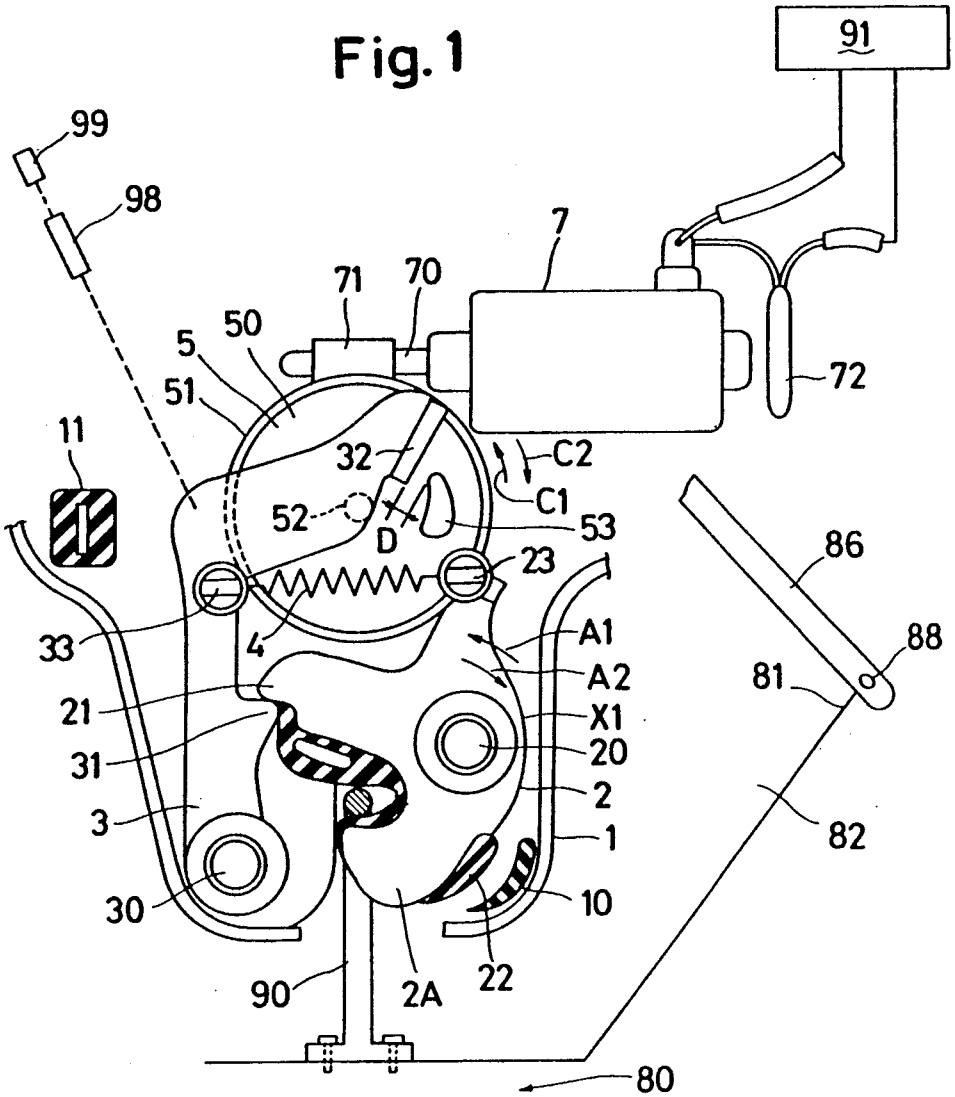
FIG. 1 is a schematic view showing how a lid is held in engagement with a striker in a luggage door-lock device according to one embodiment of the present invention.
Figure 3:
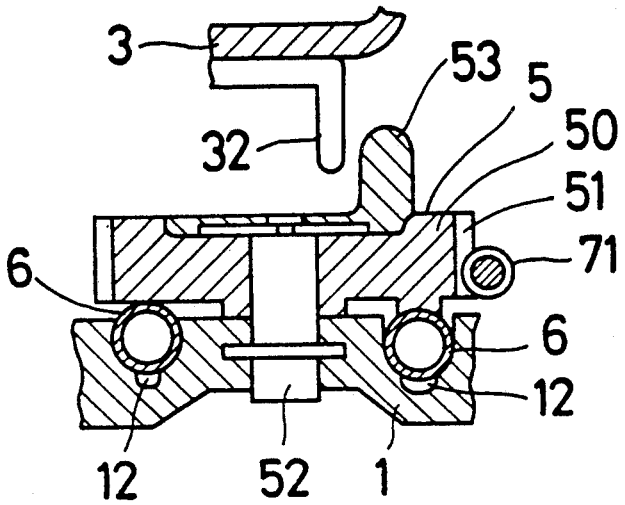
FIG. 3 is a cross-sectional view of a portion of the worm-wheel.

A base 1 is secured to a lid 86 which is pivoted to the vehicle body 80 at 88. A latch 2 is rotatably mounted on a shaft 20 which is secured to the base 1 and has a pawl 2A which is in a hook engagement with a striker 90 which is secured to the vehicle body 80. It is noted that the latch 2 is movable between a first position at which the pawl 2A is in hook-engagement with the striker 90 as shown in FIG. 1 and a second position at which the pawl 2A is in disengagement with the striker 90 as partially shown in FIG. 4. The latch 2 has a shoulder 21 and a rubber-stopper 22 which is brought into engagement with a rubber-stopper 10 for preventing excess rotation of the latch 2.

A swing member 3 is rotatably mounted on a shaft 30 which is secured to the base 1. The rotation of the swing member 3 is restricted by a rubber stopper 11 secured to the base 1. At an intermediate portion of the swing member 3, there is formed a shoulder 31 which is in engagement with the shoulder 21 of the latch 2 for retaining the latch 2 at the first position thereof. A distal end portion of the swing member 3, is provided with a projection 32.

Opposite ends of a spring 4 which is in the form of a stretched spring are fixed to a retaining portion 33 of the swing member 3 and a retaining portion 23 of the latch 2, respectively, thereby assuring the engagement between the swing member 3 and the latch 2.

A worm-wheel 5 includes a main body 50 in the form of an annular plate and a geared portion 51 provided at peripheral portion thereof. The main body 50 is rotatable on a shaft 52 which is secured to the base 1. On an upper side of the main body 50, there is provided a projection 53 with a set clearance D between it and the projection 32. As seen from FIGS. 2 and 3, a return spring 6 is accommodated within a groove 12 formed in the base 1. The return spring 6 is interposed between a retaining portion 14 of the base 1 and a retaining portion 54 of the main body 50.

Figure 5:
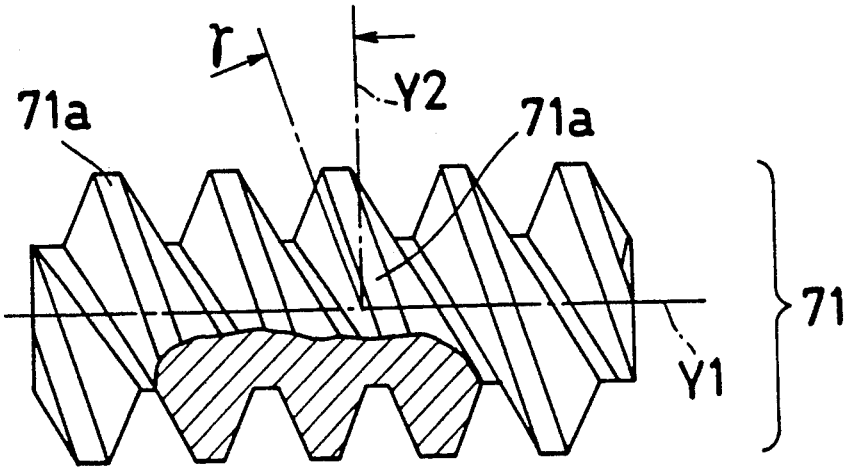
FIG. 5 is a view showing an advance angle of a worm-gear.

A motor 7 is fixedly mounted on the base 1 and has a shaft 70 on which a worm 71 is secured. The worm 71 is in mesh engagement with the geared portion 51 of the worm-wheel 5. The motor 7 is connected to a power supply 91 via a PTC-thermistor 72. As best shown in FIG. 5, the worm F1 has an advancing angle $\gamma$ is larger than a frictional angle $\phi$. It is noted the former is defined by an inclination of each gear 71 relative to a line Y2 which is perpendicular to an axis Y1 of the worm 71. Due to such arrangement, the worm-wheel 5 is rotated upon rotation of the worm 71 and vice versa. In light of the fact that the frictional coefficient $\mu$ equals tan $\phi$, the worm 71 is made of phosphor bronze and the worm-wheel 5 is made of synthetic resin so as to obtain $\mu$ ranging from 0.1 to 0.15. Thus, the frictional angle $\phi$ ranges from 5.71 to 8.53 degree, thereby setting the advancing angle of 8.53 degree or above.

Figure 4:
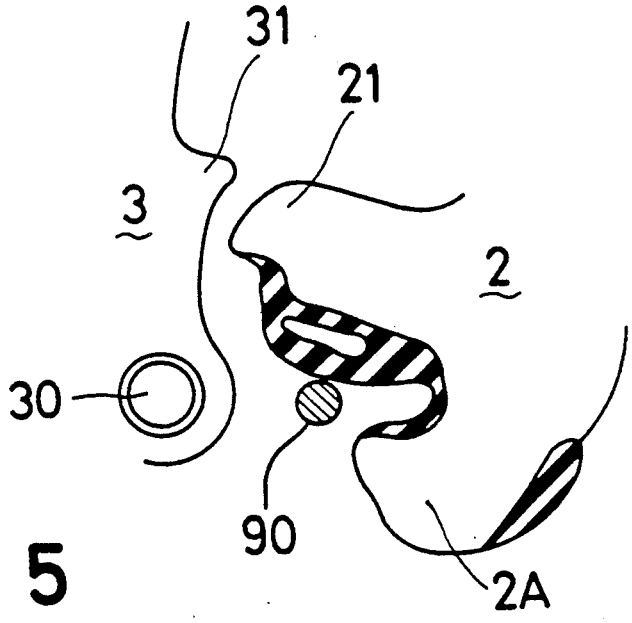
FIG. 4 is a partial view showing disengagement of the pawl from the striker.

In operation, when the motor 7 is turned on, the shaft 70 with the worm 71 is rotated, thereby rotating the main body 50 of the worm-wheel 5 with a reduced speed. Then, the projection 53 of the worm-wheel 5 is brought into rotational movement at an angle about the shaft 52 as indicated by an arrow C1. As the worm-wheel 5 rotates, elastic force is accumulated in the return spring 6. Due to the rotation of the worm-wheel 5 in the direction of C1, the projection 53 approaches the projection 32 and finally abuts thereto, Thus, the swing member 3 is brought into the counter-clockwise rotation, thereby removing the shoulder 31 of the swing member 3 from the shoulder 21 of the latch 2. Since the latch 2 is being continually urged in the counter-clockwise direction by the spring 4, this urging force is brought into application on the striker 90 which is always in the stationary condition. Since the pawl 2A has been disengaged from the striker 90, the reaction of the resulting force-application moves the door in the upward direction as shown in FIG. 4. Under this condition, a man or a woman can access the space 82 from the outside by lifting the lid 86 in the upward direction.

The motor 7 is turned off as soon as the swing member 3 abuts the rubber-stopper 11 by conventional means well known in the art. The worm-wheel 5 is rotated in the reverse direction about the shaft 52 by accumulated elastic force in the return spring 6, thereby being returned to its original or initial position. During the foregoing rotation of the worm-wheel 5, the worm 71 and the shaft 70 of the motor 7 are rotated in the reverse direction.

When the opened lid 86 is again pushed in the downward direction, the shoulder 21 of the latch 2 is brought into engagement on the shoulder 31 of the swing member 3 as soon as the pawl 2A is brought into engagement with the striker 90. Resulting engagement of the shoulders holds the elements in closed position.

It is noted that the swing member 23 can be operated by a lever 98 connected to a key-cylinder 99. The rotational speed of the motor 7 is small upon initiation and is increased gradually up to its rated value while the projection 53 moves through a stroke determined by the distance D. This means that a high-powered motor having a high initial speed is not required.

While the invention has been particularly shown and described in detail with reference to preferred embodiments thereof, it will be understood by those skilled in the art that the foregoing and other change in form and details can be made therein without departing from the spirit and scope of the invention.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A luggage-door lock device comprising:

a body having therein a space and provided with an opening through which the space is accessible;

a striker element secured to a portion of the body adjacent the opening of the body;

lid means pivoted to the body for closing the opening of the body;

a base secured to the lid;

latch means provided with a pawl and movable between a first position at which the pawl is in engagement with the striker and a second position at which the pawl is in full disengagement with striker;

a swing member pivoted to the base and having a shoulder portion engageable with the latch at the first position;

spring means disposed between the swing member and the latch so that engagement therebetween is maintained and the latch is urged continually towards the second position;

a motor having a shaft including a worm gear;

a worm-wheel provided at a peripheral portion thereof with a geared-portion engaged with the worm so that rotation is transmitted from the worm to the geared portion and vice versa, and having a projection engagable with the swing member and mounted rotatably on the base;

wherein said pawl includes a rubber-stopper which is brought into engagement with another rubber-stopper when said latch means is moved into said second position.

2. A luggage-door lock device according to the claim 1 further comprising a link mechanism through which a key-cylinder is operatively connected to the swing member.

3. A luggage-door lock device comprising:

a body having therein a space and provided with an opening through which the space is accessible;

a striker element secured to a portion of the body adjacent the opening of the body;

lid means pivoted to the body for closing the opening of the body;

a base secured to the lid;

latch means provided with a pawl and movable between a first position at which the pawl is in engagement with the striker and a second position at which the pawl is in full disengagement with striker;

a swing member pivoted to the base and having a shoulder portion engageable with the latch at the first position;

spring means disposed between the swing member and the latch so that engagement therebetween is maintained and the latch is urged continually towards the second position;

a motor having a shaft including a worm gear;

a worm-wheel provided at a peripheral portion thereof with a geared-portion engaged with the worm so that rotation is transmitted from the worm to the geared portion and vice versa, and having a projection engagable with the swing member and mounted rotatably on the base; and return-spring means for returning the worm-wheel to its original position upon completion of the rotation of the worm-wheel for disengaging the pawl and the striker;

wherein said pawl includes a rubber-stopper which is brought into engagement with another rubber-stopper when said latch means is moved into said second position.

4. A luggage door lock device according to claim 1 wherein said spring means extends axially when said latch means moves from said first position to said second position.

5. A luggage-door lock device comprising:

a body having therein a space and provided with an opening through which the space is accessible;

a striker element secured to a portion of the body adjacent the opening of the body;

lid means pivoted to the body for closing the opening of the body;

a base secured to the lid;

latch means provided with a pawl and movable between a first position at which the pawl is in engagement with the striker and a second position at which the pawl is in full disengagement with striker;

a swing member pivoted to the base and having a shoulder portion engageable with the latch at the first position;

spring means disposed between the swing member and the latch so that engagement therebetween is maintained and the latch is urged continually towards the second position;

a motor having a shaft including a worm gear;

a worm-wheel provided at a peripheral portion thereof with a geared-portion engaged with the worm so that rotation is transmitted from the worm to the geared portion and vice versa, and having a projection engagable with the swing member and mounted rotatably on the base; and return-spring means for returning the worm-wheel to its original position upon completion of the rotation of the worm-wheel for disengaging the pawl and the striker;

wherein said swing member abuts a rubber-stopper when said latch mean sis moved into said second position.

6. A luggage door lock device according to claim 1, further comprising return spring means for returning the worm-wheel to its original position upon completion of the rotation of the worm-wheel for disengaging the pawl and the striker.

* * * * *